US010533403B2

(12) United States Patent
Lawrence et al.

(10) Patent No.: US 10,533,403 B2
(45) Date of Patent: Jan. 14, 2020

(54) SLUG FLOW INITIATION IN FLUID FLOW MODELS

(71) Applicants: Schlumber Technology Corporation, Sugar Land, TX (US); Institutt for energiteknikk, Kjeller (NO)

(72) Inventors: Christopher John Lawrence, Kjeller (NO); Bin Hu, Kjeller (NO)

(73) Assignees: Schlumberger Technology Corporation, Sugar Land, TX (US); Institutt for energiteknikk, Kjeller (NO)

( * ) Notice: Subject to any disclaimer, the term of this patent is extended or adjusted under 35 U.S.C. 154(b) by 1194 days.

(21) Appl. No.: 14/552,054

(22) Filed: Nov. 24, 2014

(65) Prior Publication Data

US 2015/0149138 A1 May 28, 2015

Related U.S. Application Data

(60) Provisional application No. 61/908,413, filed on Nov. 25, 2013.

(51) Int. Cl.
*E21B 43/12* (2006.01)

(52) U.S. Cl.
CPC ..... *E21B 43/12* (2013.01)

(58) Field of Classification Search
None
See application file for complete search history.

(56) References Cited

U.S. PATENT DOCUMENTS

| | | | |
|---|---|---|---|
| 5,550,761 | A | 8/1996 | Pauchon et al. |
| 7,027,968 | B2 | 4/2006 | Choe et al. |
| 7,434,621 | B2 | 10/2008 | Aarvik et al. |
| 2010/0011876 | A1 | 1/2010 | Vyas et al. |
| 2012/0185220 | A1 | 7/2012 | Shippen |
| 2012/0211228 | A1 | 8/2012 | Troshko et al. |
| 2013/0246011 | A1 | 9/2013 | Nikolayev et al. |
| 2013/0317791 | A1 | 11/2013 | Danielson |

FOREIGN PATENT DOCUMENTS

EP 1986061 A1 10/2008

OTHER PUBLICATIONS

Jeffreys, "On the Formation of Water Waves by Wind," Proceedings of the Royal Society A, 1925, 107, pp. 189-206.
Kadri, et al., "Prediction of the transition from stratified to slug flow or roll-waves in gas-liquid horizontal pipes," International Journal of Multiphase Flow, 2009, vol. 35, pp. 1001-1010.

(Continued)

*Primary Examiner* — Craig C Dorais

(57) ABSTRACT

Systems, methods, and computer-readable media for modeling slug flow. The method includes receiving a fluid flow model comprising a representation of one or more conduits and a multiphase fluid flow therein, and determining a slug birth rate in the multiphase fluid flow. The slug birth rate is determined based at least partially on a difference between a slug front velocity and a slug tail velocity. The method also includes initiating a slug in the fluid flow model based at least partially on the slug birth rate, and displaying data representative of the slug flow in the model.

20 Claims, 4 Drawing Sheets

(56) References Cited

OTHER PUBLICATIONS

Kjeldby, et al., "Lagrangian Slug Flow Modeling and Sensitivity on Hydrodynamic Slug Initiation Methods in a Severe Slugging Case," International Journal of Multiphase Flow, 2013, vol. 53, pp. 29-39.
Kjølaas, et al., "Simulation of Hydrodynamic Slug Flow Using the Ledaflow Slug Capturing Model," Proc. 16th Int. Conf. Multiphase Production Technology, Cannes, 365-383, Jun. 12-14, 2013.
Kokal, "An experimental study of two-phase flow in inclined pipes", PhD Thesis, University of Calgary, Calgary, 1987.
Kordyban, "Some details of developing slugs in horizontal two-phase flow," AIChE Journal, 1985, vol. 31, Issue 5, pp. 802-805.
Kordyban, et al., "Interaction of linear and large wave instabilities in the formation of slugs," ASME, Gas-liquid flows, 1993, vol. 165, pp. 109-118.
Larsen,et al., "PeTra: a novel computer code for simulation of slug flow," SPE Annual Technical Conference and Exhibition held in San Antonio, Texas, Oct. 5-8, 1997, SPE 38841, pp. 965-976.
Laurinat, et al., "Pressure Drop and Film Height Measurements for Annular Gas-Liquid Flow," International Journal of Multiphase Flow, 1984, vol. 10, Issue 3, pp. 341-356.
Lin, et al., "Prediction of the initiation of slugs with linear stability theory," International Journal of Multiphase Flow, 1986, vol. 12, Issue 1, pp. 79-98.
Lyczkowski, et al., "Characteristics and stability analysis of transient one-dimensional two-phase flow equations and their finite-difference approximations," Nuclear Science and Engineering, 1978, vol. 66, pp. 378-396.
Manolis: et al., "The effect of pressure on slug frequency on two-phase horizontal flow," Presented at the 2nd International Conference on Multiphase Flow, Apr. 3-7, 1995, Kyoto, Japan.
Matar, et al., "Two-layer flow with one viscous layer in inclined channels," Mathematical Modelling of Natural Phenomena, 2008, vol. 3, No. 1, pp. 126-148.
Miya, et al., "A model for roll waves in gas-liquid flow," Chemical Engineering Science, 1971, vol. 26, Issue 11, pp. 1915-1931.
Moissis, et al., "Entrance effects in a two-phase slug flow," Journal of Heat Transfer, Transactions of the ASME, 1962, vol. 84, Issue 1, pp. 29-38.
Moody, "Friction factors for pipe flow," Transactions of the ASME, 1944 vol. 66, pp. 671-684.
Nicklin, et al., "Two phase flow in vertical tubes," Transactions of the Institution of Chemical Engineers, 1962, vol. 40, pp. 6 1-68.
Nydal, "An experimental investigation of slug flow," Ph.D. thesis, University of Olso, Oslo, Norway, 1991.
Nydal, et al., "Dynamic slug tracking simulations for gas-liquid flow in pipelines," Chemical Engineering Communications, 1996, vols. 141-142, pp. 13-39.
Pauchon, et al. "TACITE: a transient tool for multiphase pipeline and well simulation," SPE Annual Technical Conference and Exhibition held in New Orleans, LA, USA, Sep. 25-28, 1994, SPE 28545, pp. 311-326.
Ramshaw, et al., "Characteristics, stability, and short-wavelength phenomena in two-phase flow equation systems," Nuclear Science and Engineering, 1978, vol. 66, pp. 93-102.
Ransom, et al., "Hyperbolic two-pressure models for two-phase flow revisited," Journal of Computational Physics, 1988, vol. 75, Issue 2 pp. 498-504.
Ransom, et al., "Hyperbolic two-pressure models for two-phase flow," Journal of Computational Physics, 1984, vol. 53, Issue 1, pp. 124-151.
Renault, "A Lagrangian slug capturing scheme for gas-liquid flows in pipes," PhD thesis, Norwegian University of Science and Technology, Trondheim, Norway, 2007.
Saurel, et al., "A Multiphase Godunov Method for Compressible Multifluid and Multiphase Flows," Journal of Computational Physics, 1999, vol. 150, Issue 2, pp. 425-467.
Saurel, et al., "A multiphase model for compressible flows with interfaces, shocks, detonation waves and cavitation," Journal of Fluid Mechanics, 2001, vol. 431, pp. 239-271.
Shea, et al., "Slug Frequency Prediction Method Comparison," Proceedings 4th North America Conference on Multiphase Technology, Banff, Canada, Jun. 3-4, 2004.
Simmons, et al., "Transition from stratified to intermittent flow in small angle upflows," International Journal of Multiphase Flow, 2001, vol. 27, Issue 4, 599-616.
Soleimani, et al., "Critical liquid flows for the transition from the pseudo-slug and stratified patterns to slug flow," International Journal of Multiphase Flow, 2003, vol. 29, Issue 1, pp. 51-67.
Stewart, "Stability of two-phase flow calculations using two-fluid models," Journal of Computational Physics, 1979, vol. 33, pp. 259-270.
Stewart, et al., "Two-phase flow: models and methods," Journal of Computational Physics, 1984, vol. 56, pp. 363-409.
Taitel, et al., "A Model for Slug Frequency during Gas-Liquid Flow in Horizontal and Near Horizontal Pipes," International Journal of Multiphase Flow, 1977, vol. 3, Issue 6, pp. 585-596.
Taitel, et al., "Effect of gas compressibility on a slug tracking model," Chemical Engineering Science, 1998, vol. 53, Issue 11, pp. 2089-2097.
Tronconi, "Prediction of slug frequency in horizontal two-phase slug flow," AIChE Journal, 1990, vol. 36, pp. 701-709.
Ujang, et al., "Prediction of the translational velocity of liquid slugs in gas-liquid slug flow using computational fluid dynamics," Multiphase Science and Technology, 2008, vol. 20, pp. 25-79.
Ujang, et al., "Slug initiation and evolution in two-phase horizontal flow," International Journal of Multiphase Flow, 2006, vol. 32, Issue 5, pp. 527-552.
Valluri, et al., "Numerical simulation of the onset of slug initiation in laminar horizontal channel flow," International Journal of Multiphase Flow, 2008, vol. 34, Issue 2, pp. 206-225.
Wallis, "One-dimensional two-phase flow," McGraw-Hill, New York,1969.
Wallis, et al., "The Onset of Slugging in Horizontal Stratified Air-Water Flow," International Journal of Multiphase Flow, 1973, vol. 1, Issue 1, pp. 173-193.
Wang, et al., "Development of Liquid Slug Length in Gas-Liquid Slug Flow along Horizontal Pipeline: Experiment and Simulation," Chinese Journal of Chemical Engineering, Chemical Industry Press, Beijing, CN, vol. 14, No. 5, Oct. 1, 2006, pp. 626-633.
Watson, "The Modelling of Slug Flow Properties," Proceedings 10th International Conference on Multiphase Production Technology, Cannes, France: Jun. 13-15, 2001, pp. 67-86.
Woods, et al., "Frequency and development of slugs in a horizontal pipe at large liquid flows," International Journal of Multiphase Flow, 2006, vol. 32, Issue 8, pp. 902-925.
Woods, et al., "Influence of Froude number on physical processes determining frequency of slugging in horizontal gas-liquid flows," International Journal of Multiphase Flow, 1999, vol. 25, Issue 6-7, pp. 1195-1223.
Woods, et al., "Mechanism of slug formation in downwardly inclined pipes," International Journal of Multiphase Flow, 2000, vol. 26, Issue 6, pp. 977-998.
Woods, et al., "Relation of Slug Stability to Shedding Rate," International Journal of Multiphase Flow, 1996, vol. 22, Issue 5, pp. 809-828.
Wu, et al., "Flow pattern transitions in two-phase gas/condensate flow at high pressure in an 8-inch horizontal pipe," In: Proceedings BHRA Conference, The Hague, Netherlands, 1987, pp. 13-21.
Zabaras, "Prediction of Slug Frequency for Gas/Liquid Flows," SPE 65093, SPE Journal, vol. 5, No. 3, Sep. 2000, pp. 252-258.
Lawrence et al., "Mechanistic Models for Three-Phase Stratified and Slug Flows With Dispersions", BHR Group, 2013 Multiphase 16, p. 283-296.
Examination Report for the equivalent Australian patent application 2014352632 dated Oct. 10, 2017.
Zheng, et al., "Slug flow behaviour in a hilly terrain pipeline," International Journal of Multiphase Flow, 1994, vol. 20, No. 1, pp. 63-79.
Zoeteweij, "Long liquid slugs in horizontal tubes," PhD thesis, University of Delft, Netherlands, ISBN 978-90-9022512-8, 2007.

(56) References Cited

OTHER PUBLICATIONS

International Search Report and Written Opinion for the equivalent International patent application PCT/US2014/067442 dated Feb. 27, 2015.
Search Report for the equivalent European patent application 14863428.0 dated Jun. 8, 2017.
Al-Safran, "Investigation and prediction of slug frequency in gas/liquid horizontal pipe flow," Journal of Petroleum Science and Engineering, 69, 2009, pp. 143-155.
Al-Safran, et al., "Investigation of slug flow characteristics in the valley of a hilly-terrain pipeline," International Journal of Multiphase Flow, 2005, vol. 31, Issue 3, pp. 337-357.
Al-Safran, et al., "Prediction of slug length distribution along a hilly terrain pipeline using a slug tracking model," Proceedings of the 10th International Multiphase Conference, Cannes, France, Jun. 13-15, 2001, pp. 49-66.
Andreussi, "Droplet transfer in two-phase annular flow," International Journal of Multiphase Flow, 1983 vol. 9, Issue 6, pp. 697-713.
Andreussi, et al., "An investigation of void fraction in liquid slugs for horizontal and inclined gas-liquid pipe flow," International Journal of Multiphase Flow, 1989, vol. 15, Issue 6, pp. 937-946.
Andritsos, et al., "Interfacial instabilities for horizontal gas-liquid flows in pipelines," International Journal of Multiphase Flow, 1987, vol. 13, Issue 5, pp. 583-603.
Baer, et al., "A Two-Phase Mixture Theory for the Deflagration-To-Detonation Transition (DDT) in Reactive Granular Materials," International Journal of Multiphase Flow, 1986, vol. 12, Issue 6, pp. 861-889.
Barnea, et al., "A Model for Slug Length Disthbution in Gas-Liquid Slug Flow," International Journal of Multiphase Flow, 1993 vol. 19, Issue 5, pp. 829-838.
Bendiksen, "An Experimental Investigation of the Motion of Long Bubbles in Inclined Tubes," International Journal of Multiphase Flow, 1984, vol. 10, Issue 4, pp. 467-483.
Bendiksen, et al., "Physical and numerical simulation of dynamics two-phase flow in pipelines with application to existing oil-gas field lines," Conf. on Multiphase Flow in Industrial Plants, Bologna, Sep. 27-29, 1988.
Bendiksen, et al., "The Dynamic Two-Fluid Model OLGA: Theory and Application," SPE Production Engineering, May 1991, SPE-19451, pp. 171-180.
Black, et al., "Tests of the TRAC code against known analytical solutions for stratified flow," Paper presented at the 14th NRC Water Reactor Safety Meeting, Oct. 1986, Gaithsburg, Maryland, USA, p. 28.
Bonizzi, "Transient one-dimensional modelling of multiphase slug flows." PhD Thesis, 2003, Dept. of Mechanical Engineering, Imperial College, London.
Bonizzi, et al., "A model for simulating gas bubble entrainment in two-phase horizontal slug flow," International Journal of Multiphase Flow, 2003, vol. 29, Issue 11, pp. 1685-1717.
Bonizzi, et al., "Flow regime independent, high resolution multi-field modelling of near-horizontal gas-liquid flows in pipelines," International Journal of Multiphase Flow, 2009, vol. 35, Issue 1, pp. 34-46.
Bouré, "Two-phase flow models: the closure issue. Multiphase Science and Technology," Hewitt, G. F., Delhaye, J. and Zuber, N. editors. 1987, vol. 3, Chapter I, Hemisphere, New York, pp. 3-30.
Bouré, "Wave phenomena and one-dimensional two-phase flow models part I: kinematic waves; experimental results; theory," Multiphase Science and Technology, 1997a, vol. 9, pp. 1-35.
Bouré, "Wave phenomena and one-dimensional two-phase flow models part II: a reference case; flow, without mass transfer, of two fluids of constant properties," Multiphase Science and Technology, 19979b, vol. 9, pp. 37-62.
Bouré, "Wave phenomena and one-dimensional two-phase flow models part III: general case; general drift flux models; Other two-fluid models," Multiphase Science and Technology, 1997c, vol. 9, pp. 63-107.
Brill et al., "Analysis of two-phase tests in large-diameter flow lines in Prudhoe Bay field," Society of Petroleum Engineers of AIME, Jun. 1981, pp. 363-378.
Cook, et al., "Slug length prediction in near horizontal gas-liquid intermittent flow," Chemical Engineering Science, 2000, vol. 55, Issue 11, pp. 2009-2018.
Coquel, et al., "A Numerical Method Using Upwind Schemes for the Resolution of Two-Phase Flows," Journal of Computational Physics, 1997, vol. 136, Issue 2, pp. 272-288.
Coquel, et al., "An energy relaxation method for inviscid real fluid flows and application to two-phase flows," Baines, M. J. editor. Numerical Methods for Fluid Dynamics, VI, 1998, Oxford University Press, Oxford.
Coquel, et al., "Relaxation of energy and approximate Riemann solvers for general pressure laws in fluid dynamics," SIAM Journal on Numical Analysis,1998, vol. 35, No. 6, pp. 2223-2249.
Daniels, et al., "An implicit one-dimensional two-phase compressible flow solver for pipelines," Multiphase Science and Technology, 2002, vol. 14, Issue 2, pp. 107-202.
De Henau, "A study of terrain-induced slugging in two-phase flow pipelines," PhD Thesis, 1992, University of Waterloo, Waterloo, Ontario, Canada.
De Henau, et al., "A Transient Two-Fluid Model for the Simulation of Slug Flow in Pipelines—1. Theory," International Journal of Multiphase Flow, vol. 21, No. 3, 1995 pp. 335-349.
De Henau, et al., "Transient two-fluid model for the simulation of slug flow in pipelines—2. Validation," International Journal of Multiphase Flow, vol. 21, No. 3, 1995, pp. 351-363.
Dukler, et al., "A Model for Gas-Liquid Slug Flow in Horizontal and Near Horizontal Tubes," Industrial & Engineering Chemistry Fundamentals, 1975, vol. 14, Issue 4, pp. 337-347.
Dumitrescu. "Stromung an einer Luftblase in senkrecten Rohr," ZAMM—Journal of Applied Mathematics and Mechanics, 1943, vol. 23, Issue 3, pp. 139-149.
Fan, et al., "Initiation of slugs in horizontal gas-liquid flows," AIChE Journal, Fluid Mechanics and Transport Phenomena, 1993, vol. 39, Issue 11, pp. 1741-1753.
Gilchrist, et al., "Modelling of slug flow accounting for slug growth and acceleration effects," Multiphase Production edited by A. P. Burns, Proceedings of the 5th International Conference on Multiphase Production, Cannes, France, 1991, pp. 265-280.
Glimm, et al., "Two-phase modelling of a fluid mixing layer," Journal of Fluid Mechanics, 1999, vol. 378, pp. 119-143.
Glimm, et al., "Two-pressure two-phase flow," Chen, C., Li, Y. and Zhu, X. editors. Nonlinear Partial Differential Equations, World Scientific, Singapore, 1998.
Gregory, et al., "Correlation of the Liquid Volume Fraction in the Slug for Horizontal Gas-Liquid Slug Flow," International Journal of Multiphase Flow, 1978, vol. 4, Issue 1, pp. 33-39.
Gregory, et al., "Correlation of liquid slug velocity and frequency in horizontal cocurrent gas-liquid slug flow," AIChE Journal, 1969, vol. 15, Issue 6, pp. 933-935.
Greskovich, et al., "Slug frequency in horizontal gas-liquid slug flow," Industrial & Engineering Chemistry Process Design and Development, 1972, vol. 11 (2), pp. 317-318.
Gu, et al., "Experimental Investigation of Slug Development on Horizontal Two-Phase Flow," Chinese Journal of Chemical Engineering, 2008, vol. 16, Issue 2, pp. 171-177.
Heywood, et al., "Slug flow of air-water mixtures in a horizontal pipe: determination of liquid holdup by gamma-ray absorption" Chemical Engineering Science, 1979, vol. 34, Issue 1, pp. 17-30.
Hill, et al. "Slug Flow: Occurrence, Consequence and Prediction," Presentation at the University of Tulsa Centennial Petroleum Engineering Symposium held in Tulsa, OK, USA, Aug. 29-31, 1994.
Hill, et al., "A new approach to the prediction of slug frequency," 65th Annual Technical Conference and Exhibition of the Society of Petroleum Engineers held in New Orleans, LA, Sep. 23-26, 1990.
Hu, et al., "Model for Tracking the Evolution of Slugs and Waves in Straight Pipelines," Proceedings of the ICMF 2007, 6th International Conference on Multiphase Flow, Leipzig, Germany, Jul. 9-13, 2007.
Hu, et al., "Void Distribution in the Liquid Layer in Stratified Wavy Flows Measured with an X-Ray Computed Tomography Instru-

(56) References Cited

OTHER PUBLICATIONS ment," 14th International Conference on Multiphase Production Technology, Cannes, France, Jun. 17-19, 2009.
Hurlburt, et al., "Prediction of the transition from stratified to slug and plug flow for long pipes," International Journal of Multiphase Flow, 2002, vol. 28, Issue 5, pp. 707-729.
Ishii, et al., "Two-fluid model and hydrodynamic constitutive relations," Nuclear Engineering and Designs, 1984, vol. 82, pp. 107-126.
Issa, et al., "Numerical prediction of instabilities and slug formation in horizontal two-phase flows," 3rd International Conference on Multiphase Flow, ICMF'98, Lyon, France, Jun. 6-10, 1998.
Andreussi, et al., "Stratified gas-liquid flow in downwardly inclined pipes," International Journal of Multiphase Flow, 1987, vol. 13, Issue 4, pp. 565-575.
Mo, et al., "Quasi-3D Modelling of Two-Phase Slug Flow in Pipes," in: Ninth International Conference on CFD in the Minerals and Process Industries, Australia: CSIRO, Dec. 12, 2012.
Rahimi, et al., "The Indication of Two-Phase Flow Paattern and Slug Characteristics in a Pipeline Using CFD Method" Gas Processing Journal, Jan. 2013, vol. 1, No. 1, pp. 70-87.
Taitel, et al., "Slug-Tracking Model for Hilly Terrain Pipelines," SPE Journal, vol. 5, No. 1, Mar. 2000, pp. 102-109.
Taitel, et al., "Two-phase slug flow," Advances in Heat Transfer, 1990, vol. 20, pp. 83-132.
Shemer, et al., "Visualization of the instantaneous velocity profiles in gas-liquid slug flow," Physicochemical Hydrodynamics, 1987, vol. 8, No. 3, pp. 243-253.
Khor, "Three phase liquid-liquid-gas stratified flow in pipelines," PhD Thesis. Imperial College London, Jan. 1998.
King, "Experimental and modelling studies of transient slug flow," PhD Thesis, Imperial College London, Mar. 1998.
Manfield, "Experimental, computational and analytical studies of slug flow," PhD Thesis. Imperial College London, Aug. 2000.
Ng, "Interfacial structure of stratified pipe flow," PhD Thesis. Imperial College London, 2002.
Srichai, "High pressure separated two-phase flow," PhD Thesis, 1994, Imperial College London.
Ujang, "Studies of slug initiation and development in two-phase gas-liquid pipeline flow," PhD Thesis, Imperial College, London, UK, 2003.
Davies, "Studies of Two-phase Intermittent Flow in Pipelines," Ph.D. Thesis, University of London, London, UK, 1992.

SLUG FLOW INITIATION IN FLUID FLOW MODELS

CROSS-REFERENCE TO RELATED APPLICATIONS

This application claims priority to U.S. Provisional Patent Application Ser. No. 61/908,413, which was filed on Nov. 25, 2013. This provisional application is incorporated herein by reference in its entirety.

BACKGROUND

Slug flow is a type of multiphase flow that can occur in fluid transport lines. More particularly, slug flow is an intermittent flow in which regions of separated flow with large gas pockets alternate with regions of dispersed flow ("slugs") in which small gas bubbles are dispersed into the liquid. The separated flow may be stratified flow in pipelines that are oriented horizontally or with relatively small inclination to the horizontal, or annular flow in other cases. The various types of slug flow may be generally referred to by the conditions that lead to their creation. For example, operational or "start-up" slugs may occur after flow through a pipeline is started, e.g., after stopping flow, such that liquid has settled to low points in the pipe, and then restarting the flow. Similarly, terrain slugs may be caused by the topography of the pipelines, and hydrodynamic slugs may be caused during "normal" conditions by the presence of one or more regions where there is too much liquid for separated flow to be stable and too little liquid for bubbly flow.

SUMMARY

Embodiments of the disclosure may provide systems, methods, and computer-readable media for modeling slug flow, e.g., in a pipeline. The method includes receiving a fluid flow model comprising a representation of one or more conduits and a multiphase fluid flow therein, and determining a slug birth rate in the multiphase fluid flow. The slug birth rate is determined based at least partially on a difference between a slug front velocity and a slug tail velocity. The method also includes initiating a slug in the fluid flow model based at least partially on the slug birth rate, and displaying data representative of the slug flow in the model.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
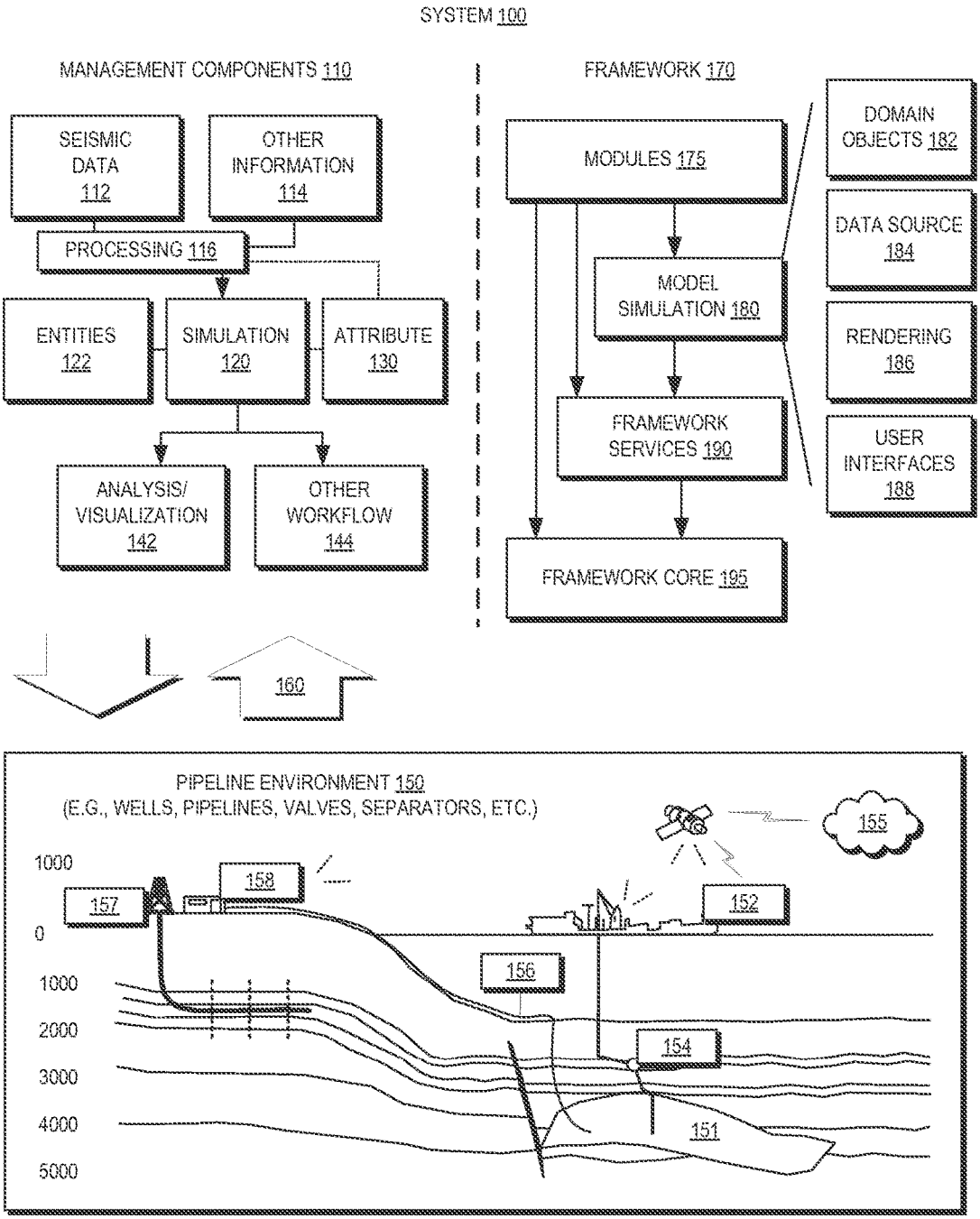
FIG. 1 illustrates an example of a system that includes various management components to manage various aspects of a pipeline environment, according to an embodiment.

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc., may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both, objects or steps, respectively, but they are not to be considered the same object or step.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

Multiphase flow, including slug flow, may be modeled and simulated. Multi-dimensional simulation presents a challenge, however, as it may require an impractical amount of computing resources and/or time. Thus, at least for long pipelines, one-dimensional models may be employed, in which properties of the flow are averaged over the pipe cross-section. The model then describes how these averaged properties vary along the pipeline and with time.

Such models may implement various strategies for modeling slug flow. For example, in "slug tracking," the boundaries (front and tail) of the slugs are followed as they propagate along the pipe. Thus, the slugs and separated zones are represented on a Lagrangian grid, which is superimposed on the Eulerian grid used to solve the basic equations. In another example, "slug capturing," the underlying equations are resolved on a fine Eulerian grid, including the growth of large waves and the formation of slugs, so that each slug is represented.

These models may provide satisfactory results in a wide variety of contexts. However, some such methods of slug flow modeling and simulation may include long computation times, accuracy and/or stability issues, and/or tuning to match experimental or otherwise measured datasets, such as by using an iterative, trial-and-error process.

FIG. 1 illustrates an example of a system 100 that includes various management components 110 to manage various aspects of a pipeline environment 150 (e.g., an environment that includes wells, transportation lines, risers, chokes, valves, separators, etc.). For example, the management components 110 may allow for direct or indirect management of design, operations, control, optimization, etc., with respect to the pipeline environment 150. In turn, further information about the pipeline environment 150 may become available as feedback 160 (e.g., optionally as input to one or more of the management components 110).

In the example of FIG. 1, the management components 110 include a pipeline configuration component 112, an additional information component 114 (e.g., fluid measurement data), a processing component 116, a simulation component 120, an attribute component 130, an analysis/visualization component 142 and a workflow component 144. In operation, pipeline configuration data and other information provided per the components 112 and 114 may be input to the simulation component 120.

In an example embodiment, the simulation component 120 may rely on pipeline components or "entities" 122. The pipeline components 122 may include pipe structures and/or equipment. In the system 100, the components 122 can include virtual representations of actual physical components that are reconstructed for purposes of simulation. The components 122 may include components based on data acquired via sensing, observation, etc. (e.g., the pipeline configuration 112 and other information 114). An entity may be characterized by one or more properties (e.g., a pipeline model may be characterized by changes in pressure, heat transfer, pipe inclination and geometry, etc.). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT® .NET® framework (Redmond, Wash.), which provides a set of extensible object classes. In the .NET® framework, an object class encapsulates a module of reusable code and associated data structures. Object classes can be used to instantiate object instances for use by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the pipeline environment 150, which may be relied on to simulate behavior of the pipeline environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as a simulator provided in OLGA® (Schlumberger Limited, Houston Tex. Further, in an example embodiment, the management components 110 may include features of a commercially available framework such as OLGA® or the PETREL® seismic to simulation software framework (Schlumberger Limited, Houston, Tex.). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, pipeline engineers, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (Schlumberger Limited, Houston, Tex.) allows for integration of add-ons (or plug-ins) into OLGA® or a PETREL® framework workflow. The OCEAN® framework environment leverages .NET® tools (Microsoft Corporation, Redmond, Wash.) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially-available OCEAN® framework where the model simulation layer 180 may be either OLGA® or the commercially-available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of pipeline configuration, one or more attributes based at least in part on pipeline configuration, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the pipeline environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well. As an example, the equipment 157 and/or 158 may include components, a system, systems, etc. for pipeline condition monitoring, sensing, valve modulation, pump control, analysis of pipeline data, assessment of one or more pipelines 156, etc. The pipelines 156 may include at least a portion of the well, and may form part of, or be representative of, a network of pipes which may transport a production fluid (e.g., hydrocarbon) from one location to another.

As mentioned, the system 100 may be used to perform one or more workflows. A workflow may be a process that includes a number of worksteps. A workstep may operate on data, for example, to create new data, to update existing data, etc. As an example, a workstep may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in OLGA® or the PETREL® software, for example, that operates on pipeline configuration, seismic attribute(s), etc. As an example, a workflow may be a process implementable in the OCEAN® framework. As an example, a workflow may include one or more worksteps that access a module such as a plug-in (e.g., external executable code, etc.).

Figure 2:
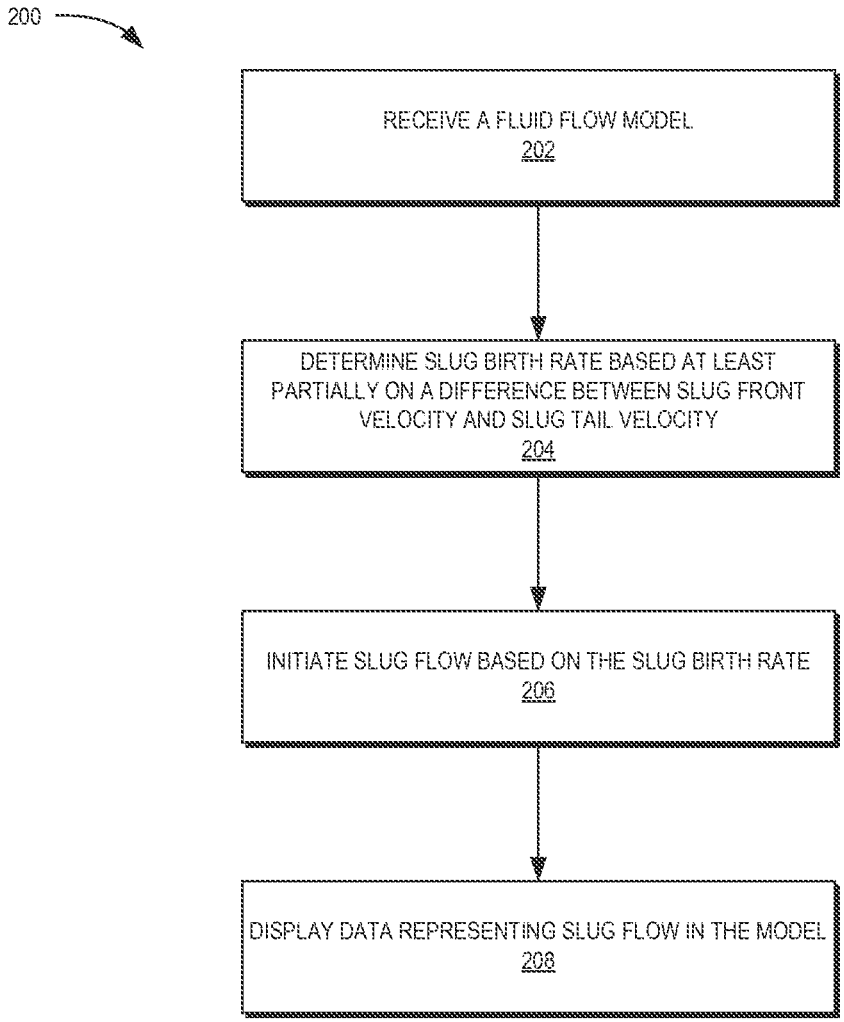
FIG. 2 illustrates a flowchart of a method for modeling slug flow in a multiphase flow, according to an embodiment.

FIG. 2 illustrates a flowchart of a method 200 for modeling a slug flow, e.g., in a multiphase fluid flow model, according to an embodiment. The method 200 may be employed as part of a fluid flow or pipeline model. The model may include representations of one or more fluid conduits (e.g., pipes, wells) and/or other pipeline equipment (compressors, pumps, separators, slug catchers, etc.). Such models may be representative of real-world, physical pipelines systems, or may be constructed as part of the planning of such systems.

Accordingly, in some embodiments, the method 200 may include creating a fluid flow model, such as by using OLGA® or any other suitable pipeline modeling/simulation system. In another embodiment, the method 200 may include receiving a completed fluid flow model. Either case may be considered as part of receiving a fluid flow model, e.g., as at 202. As indicated, the model may include a representation of one or more conduits, as well as a flow of multiphase fluid therein. The conduits may be modeled, e.g., according to geometry (e.g., diameter, length, etc.), pressure change, elevation gain, heat transfer, and/or the like. For the remainder of the present description, the model is described in terms of "pipes"; however, it will be readily apparent that the disclosure is not limited to pipes and may apply to any type of fluid conduit. In an embodiment, the multiphase fluid flow may be modeled based on the parameters of the pipes (and/or other equipment), as well as the underlying equations of mass, state, energy, etc.

The method 200 may also include determining a slug birth rate in the multiphase fluid flow, as at 204. The slug birth rate may be determined based on one or more of a variety of factors, which may be provided as part of a slug birth rate model. The birth rate, generally referred to as 'B' herein, may thus represent the number of new slugs per length of pipe per second.

The slug birth rate may be zero unless conditions exist that allow slugs to form. A first one of such conditions may be known as a "minimum slip criterion" or "slug growth criterion." More particularly, in an embodiment, the minimum slip criterion may be satisfied if, were a slug to be introduced into the flow, the velocity of the slug front $V_F$ would exceed the velocity of the slug tail $V_T$ (i.e., $V_F-V_T>0$). The difference between $V_F$ and $V_T$ may represent a mean growth rate of slugs, and may also be representative of a distance from the minimum slip boundary, or the degree of instability of the local separated flow. Accordingly, the value of the difference may represent a driving force, and thus an increasing probability, for new slugs to form, as will be described below. For a slug to be counted (e.g., in the determination of N, below) it may have a length of at least the pipe diameter D. Thus, the time for a slug to form may scale as $D/(V_F-V_T)$, and the rate at which new slugs form may scale as $(V_F-V_T)/D$.

To determine slug tail velocity $V_T$, a correlation for slug tail velocity $V_T$ may be implemented in terms of mixture velocity $u_M$, gravity g, pipe diameter D, inclination angle above the horizontal θ, and/or other quantities. Accordingly, slug tail velocity $V_T$ may be defined as:

$$V_T=f(u_M, g, D, \theta, \ldots) \quad (1)$$

The slug front velocity $V_F$ may be given by a mass balance across the slug front:

$$(V_F-u_{GS}{}^F)\alpha_{GS}{}^F=(V_F-u_{GB}{}^T)\alpha_{GB}{}^T \quad (2)$$

Solving equation (2) for $V_F$:

$$V_F = \frac{\alpha_{GB}^T u_{GB}^T - \alpha_{GS}^F u_{GS}^F}{\alpha_{GB}^T - \alpha_{GS}^F} \tag{3}$$

where $\alpha_{GS}^F$ and $u_{GS}^F$ represent the cross-sectional holdup and cross-sectional mean velocity of gas at the front of the slug, respectively, and $\alpha_{GB}^T$ and $u_{GB}^T$ represent the same quantities at the tail of the zone of separated flow immediately ahead of the slug. Further, equations (2) and (3) may be evaluated when slugs are not present. In such case, values for $\alpha_{GS}^F$ and $u_{GS}^F$ may be provided (e.g., as hypothetical values), while $\alpha_{GB}^T$ and $u_{GB}^T$ may take values corresponding to the separated flow.

When the minimum slip criterion (first condition) is satisfied, slugs may grow from the slug precursors, if such precursors are available (second condition). The spatial frequency of slug formation may thus be proportional to the number of large waves (or slug precursors) per unit pipe length $N_W$. However, the presence (or proximity) of slugs may decrease the subsequent formation of slugs, and thus the birth rate B may take into consideration slugs that have already formed. Accordingly, the second condition that may be satisfied in order for slug flow to exist may be that the density of slugs present in the pipe N (slugs per unit length of pipe) may not exceed the density of large wave slug precursors (i.e., $N_W - N > 0$).

To determine the number of slug precursors or large waves, a delay constant may be implemented. As such, the density of large wave slug precursors $N_W$ may be estimated, as $N_W = u_L/(V_T \Omega D)$, where $\Omega$ is the delay constant and $u_L$ is the local mean liquid velocity. In another embodiment, a mechanistic model for slug initiation frequency may be employed. For example, at the threshold of slug formation, the wave profile may be considered to be similar to the tail profile of an incipient slug, and the wave speed may approach the slug tail velocity. As such, the wavelength of the slug may be estimated using a quasi-steady slug tail profile model. The local slug density N at a particular grid point or control volume may be estimated based on the distances to the nearest slugs (if any) in each direction along the pipeline. If no slugs exist in either direction, then the slug density is zero.

In an embodiment, the wave profile may be obtained by solving a first order, ordinary differential equation for liquid holdup $\alpha_{LW}(\xi)$, $$\frac{d\alpha_{LW}}{d\xi} = \frac{Z}{Y} \tag{4}$$

This may represent a reduced form of a steady-state, two- (or more) fluid model, which may be based at least in part on an assumption that the wave (slug precursor) propagates without changing shape. As such, the flow may be considered quasi-steady in a frame of reference moving with the tail speed. In equation (4), $\xi$ represents the spatial coordinate measured backwards from the wave crest (tail of the slug precursor). In the two-fluid model, Z represents the equilibrium terms: friction and the axial component of gravity, which in the case where the separated flow is stratified are according to equation (5):

$$Z = \frac{\tau_{LW} S_{LW} - \tau_{LW} S_{LW}}{\alpha_{LW} A} + \frac{\tau_{LW} S_{LW} + \tau_{GW} S_{GW}}{(1-\alpha_{LW})A} - (\rho_L - \rho_G) g \sin\theta \tag{5}$$

The denominator Y in equation (4) may represent one or more non-equilibrium terms, such as inertial and hydraulic gradient terms, which, for stratified flow, may be:

$$Y = \rho_L \frac{\hat{u}_{SL}^2}{\alpha_{LW}^3} + \rho_G \frac{\hat{u}_{SG}^2}{(1-\alpha_{LW})^3} - (\rho_L - \rho_G) g \cos\theta \frac{A}{S_{IW}} \tag{6}$$

The terms $\tau_{IW}$, $\tau_{LW}$, and $\tau_{GW}$ represent the shear stresses between the gas and liquid, between the liquid and the pipe wall, and between the gas and the pipe wall, respectively, while $S_{IW}$, $S_{LW}$, and $S_{GW}$ represent the corresponding perimeter lengths, and the subscript 'W' denotes "wave." A is the pipe cross-sectional area, $\hat{u}_{SL}$ and $\hat{u}_{SG}$ are the superficial velocities of liquid and gas, respectively, relative to the moving frame of reference, $\rho_L$ and $\rho_G$ are the liquid and gas densities, respectively, g is the acceleration of gravity and $\theta$ represents the angle of inclination of the pipe above the horizontal.

The mean holdup may be determined by integration over the wave profile:

$$\overline{\alpha_{LW}} = \frac{1}{L_W} \int_0^{L_W} \alpha_{LW}(\xi)\, d\xi \tag{7}$$

where $L_W$ is the distance between the tail of one slug precursor and the front of the next. Further, the slug length of the slug precursor may be set to zero, or any other value, for example a length of a few diameters, in order to determine the frequency of slug precursors. Moreover, an approximate solution may be introduced for the wave profile in the exponential form, as equation (8):

$$\alpha_{LW} \approx \tilde{\alpha}_{LW}(\xi) = \alpha_{LW}^E + (\alpha_{LW}^O - \alpha_{LW}^E) e^{-k\xi} \tag{8}$$

where $\alpha_{LW}^E$ is a hypothetical equilibrium holdup achieved for a very long wave tail, $\xi \to \infty$, $Z \to 0$, and $\alpha_{LW}^O$ is the hold up at the wave crest (slug tail), which may be set equal to the slug body holdup of the incipient slug. When the void in the slug is neglected, $\alpha_{LW}^O$ may be set to unity. As such, the mean holdup value of the liquid corresponding to the approximate profile may be:

$$\overline{\alpha_{LW}} \approx \alpha_{LW}^E + (\alpha_{LW}^0 - \alpha_{LW}^E) \frac{1}{kL_W} (1 - e^{-kL_W}) \tag{9}$$

In an embodiment, the product $kL_W$ may be about three (or another, moderately large number), so that the stratified zone is long enough for the liquid level to approach the equilibrium value and the exponential term in equation (9) may be neglected. In such a case, $L_W$ may be determined from:

$$L_W \approx \frac{1}{k} \frac{\alpha_{LW}^0 - \alpha_{LW}^E}{\overline{\alpha_{LW}} - \alpha_{LW}^E} \tag{10}$$

To estimate the value of k, the spatial derivative of the exponential profile may be given as:

$$\frac{d\tilde{\alpha}_{LW}}{d\xi} = -k(\alpha_{LW}^{0} - \alpha_{LW}^{E})e^{-k\xi} = -k(\tilde{\alpha}_{LW} - \alpha_{LW}^{E}) \tag{11}$$

so that a value of the exponential coefficient k may be estimated from $$k \approx k^{R} = -\left[\frac{1}{\alpha_{LW} - \alpha_{LW}^{E}}\frac{d\alpha_{LW}}{d\xi}\right]_{\alpha_{LW}=\alpha_{LW}^{R}} = \frac{-1}{\alpha_{LW}^{R} - \alpha_{LW}^{E}}\left[\frac{Z}{Y}\right]_{\alpha_{LW}=\alpha_{LW}^{R}} \tag{12}$$

Here, $\alpha_{LW}^{R}$ may be a reference value of the holdup taken at a point along the profile. In an embodiment, the value of $\alpha_{LW}^{R}$ may be selected such that the half-angle δ subtended by the liquid layer at the pipe center is between the equilibrium value $\delta^{E}$ and the value of the slug tail $\delta^{O}$, weighted by a fraction $C_K$:

$$\delta^{R}=\delta^{E}+C_{K}(\delta^{O}-\delta^{E}) \tag{13}$$

The fraction $C_K$ may serve as a tuning variable in the model. The value may be predetermined or received, e.g., from a user, as part of the method 200. For example, the fraction may be set as 0.18, but in other embodiments, may be any other suitable number. The holdup may be given in terms of the half angle δ by $\alpha_{LW}=(\delta-\cos\delta\sin\delta)/\pi$.

An estimate for the number of precursor waves per unit length may thus be:

$$N_{W} \approx c_{W}\frac{\overline{\alpha_{LW}} - \alpha_{LW}^{E}}{(\alpha_{LW}^{0} - \alpha_{LW}^{E})(\alpha_{LW}^{R} - \alpha_{LW}^{E})}\left[\frac{-Z}{Y}\right]_{\alpha_{LW}=\alpha_{LW}^{R}} \tag{14}$$

where $C_W$ may be a free tuning parameter, which may be set, for example, as 1.

When the wave propagates without change of form, the liquid flux relative to the moving frame of reference may be constant along the wave profile, such that:

$$\alpha_{LW}\hat{u}_{LW}\approx\hat{u}_{SL} \tag{15}$$

where $\hat{u}_{LW}=V_W-u_{LW}$ is the liquid velocity (measured backwards) relative to the wave crest (slug tail) and $\hat{u}_{SL}=V_W=u_{SL}$ is the corresponding superficial velocity. Continuity of liquid holdup and flux across the slug tail may give $\alpha_{LW}^{O}=\alpha_{LS}^{T}$ and $\hat{u}_{SL}=(V_W-u_{LS}^{T})\alpha_{LS}^{T}$, where $\alpha_{LS}^{T}$ and $u_{LS}^{T}$ are the holdup and velocity of liquid, respectively, at the tail of the slug precursor (e.g., the crest of the wave). In some embodiments, gas entrainment may be ignored, and $\alpha_{LS}^{T}\approx1$, $\delta^{O}=\pi$, and $u_{LS}^{T}=u_M$, such that $\hat{u}_{SL}\approx V_W-u_M$ is a local mixture velocity.

The mean liquid flux in the wave may be determined as:

$$q_L = \alpha_L u_L = \frac{1}{L_W}\int_0^{L_W} \alpha_{LW}(\xi)u_{LW}(\xi)\,d\xi \tag{16}$$

Further, as $u_{LW}=V_W-\hat{u}_{SL}/\alpha_{LW}$, liquid flux becomes:

$$q_L = \frac{1}{L_W}\int_0^{L_W} (V_W\alpha_{LW} - \hat{u}_{SL})\,d\xi = V_W\overline{\alpha_{LW}} - \hat{u}_{SL} \tag{17}$$

yielding:

$$V_W = \frac{u_M - q_L}{1 - \overline{\alpha_{LW}}} = u_G \tag{18}$$

in which $u_G$ is the mean gas velocity

For a developing flow, the liquid holdup $\alpha_L$ and the flux $q_L$ may be determined independently. As such, the wave velocity $V_W$, which may be equal to the gas velocity $u_G$ in the case with no gas entrainment, may differ from the slug tail velocity $V_T$. This potential inconsistency may be resolved in at least two ways. First, in a steady flow, the wave velocity may be equal to the slug tail velocity, $V_W=V_T$, which may be regarded as an approximation for unsteady flow. In such case, the wave model may take $\overline{\alpha_{LW}}$ to be the local value of $\alpha_L$ (and may not use the liquid flux $q_L$). Second, a local value for the liquid flux $q_L$ may be determined, and equation (18) may be employed to obtain an adjusted value for the mean holdup corresponding to the wavy flow:

$$\overline{\alpha_{LW}} = 1 - \frac{u_M - q_L}{V_T} \tag{19}$$

In this case, the wave model may use a liquid holdup value $\overline{\alpha_{LW}}$ corresponding to the local value of $q_L$ (and may not use $\alpha_L$).

In some embodiments, determining a slug death rate model may not be needed, as a slug may simply be considered to be dead with its characteristic length $L_S$ approaches zero. In other embodiments, a slug death rate may be determined. If slugs are present, and the slug tail velocity $V_T$ is greater than the slug front velocity $V_F$, the slugs may decrease in length. The mean front and tail velocity of relatively short slugs may be considered generally constant, thus the model may neglect slugs for which the tail velocity differs from the standard form. Thus, the rate at which the slugs disappear may be proportional to $(V_T-V_F)\psi(0)$. The function $\psi(L_S)$ represents the probability density function of slugs of length $L_S$, and $\psi(0)$ represents the probability density of slugs of zero (or substantially zero) length. In some embodiments, $\psi(0)$ may be proportional to $N/\overline{L_S}$ thus the death rate may be estimated by $$D = c_D\frac{N(V_T - V_F)}{\overline{L_S}},\ V_T > V_F \tag{20}$$

where $C_D$ is another dimensionless constant that may be tuned to data. Further, to avoid a potential singularity when $\overline{L_S}\rightarrow0$, an upper bound may be imposed for the slug death rate D by adding a constant to the denominator, such as the pipe diameter, thereby yielding:

$$D = c_D\frac{N(V_T - V_F)}{\overline{L_S} + D},\ V_T > V_F \tag{21}$$

In an embodiment, if both of the first condition (minimum slip criterion) and second conditions (available precursors) are satisfied, the birth rate B may be determined according to the following equation:

$$B = \frac{C_B}{D}(N_W - N)(V_F - V_T) \tag{22}$$

In equation (22), D represents the pipe diameter, and $C_B$ is a constant of proportionality that is determined by matching the model with experimental data and/or field data. The birth rate model gives the birth rate B in terms of at least two factors, which represent the degree of instability of the local stratified flow, and the spatial density of slug precursors (slugs/meter).

The method 200 may then proceed to initiating a slug flow in the fluid flow model based at least partially on the slug birth rate, as at 206. In an embodiment, initiating slug flow may be conducted according to a population equation, which may employ the birth rate and/or death rate calculated above. An example of such a population equation may be as follows:

$$\frac{\partial N}{\partial t} + \frac{\partial}{\partial x}(NU_A) = B - D \tag{23}$$

where N is the number of slugs per unit pipe length, $U_A$ is the advection velocity, B is the slug birth rate, and D is the slug death rate. In some embodiments, as mentioned above, a model for slug death may be omitted; as length approaches zero, the slug may be considered dead.

In an embodiment, the simulation of the fluid flow model may proceed according to time steps Δt, where the equations describing the state of the cells or control volumes (e.g., lengths of pipe) of the model are resolved after one, some, or each time step. Further, the number of new slugs formed may be generally described in terms of the birth rate B, the control volume length Δz and the time step Δt as:

$$\Delta N = B\Delta z\ \Delta t. \tag{24}$$

However, the pipe length Δz and/or the time step Δt may be relatively short, such that ΔN is generally less than one and greater than or equal to zero. Accordingly, embodiments of the present method 200 may employ the ΔN value as a probability. For example, the method 200 may include generating a random or psuedo-random number X, which may be uniformly distributed on the interval [0, 1]. When ΔN>X, a slug may be initiated, and if ΔN<X, a slug may not be initiated.

When one or more slug flows at one or more lengths of pipe, at a time step, are resolved, the method 200 may include displaying data representative of the slug flow, as at 208. This may take any one or more of a variety of forms and may result in a representation of an underlying object changing, based on the simulation. For example, one or more slugs may be graphically represented in a pipe. In another embodiment, a frequency of slug flow, e.g., as a plot, may be created and/or modified according to the method 200. In another embodiment, a slug length distribution, e.g., as a plot, may be created and/or modified according to the method 200. In other embodiments, other types of graphical displays based on data from the underlying actual or hypothetical physical pipeline system may be provided.

Figure 3:
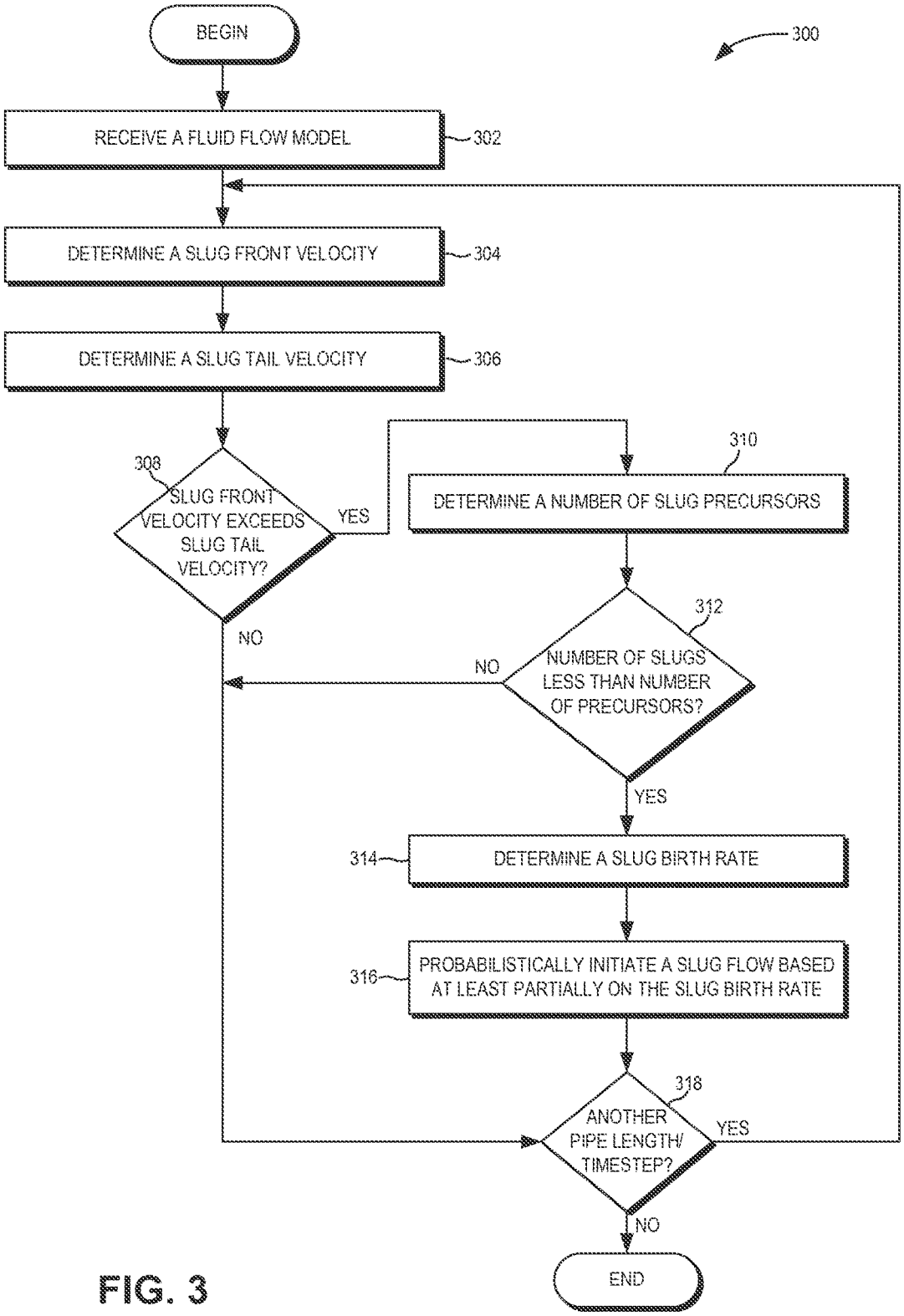
FIG. 3 illustrates another flowchart of a method for modeling slug flow in a multiphase flow, according to an embodiment.

FIG. 3 illustrates a flowchart of a method 300 for modeling slug flow in a multiphase flow, according to an embodiment. In an embodiment, the method 300 illustrated in FIG. 3 may be a more detailed view of the method 200 of FIG. 2, which may employ one or more of the calculation techniques described above. In other embodiments, however, the method 300 may proceed using different calculation techniques.

In an embodiment, the method 300 may begin by receiving a fluid flow model, as at 302, e.g., a model of a system of fluid conduits (e.g., pipes and/or other structures) through which flow is transported. The flow may be multiphase, meaning that it contains two or more phases selected from the group including of a gas, a liquid, and a number of other immiscible liquids. The method 300 may receive the model as already complete or may include constructing at least a portion of the model.

The method 300 may include conducting one or more aspects iteratively, e.g., as part of a sequence that may be based upon time steps in a simulation using the model. The time steps may be set at any time value. Accordingly, the method 300 may generally proceed by making calculations and updating the model after a certain amount of time passes in the model.

As part of such an iterative sequence, for example, the method 300 may include determining a slug front velocity for the multiphase flow in one, some, or each section of the pipe, for the time step, as at 304. The slug front velocity $V_F$ may be determined as generally described above. Further, the method 300 may include determining a slug tail velocity $V_T$, as at 306, again as generally described above.

The method 300 may then determine whether the slug front velocity exceeds the slug tail velocity, as at 308. For example, the method 300 at 308 may include determining whether the minimum slip criterion is met. If it is not, the method 300 may move to the next time step (or to a next length of pipe, etc.). When the determination at 308 is 'YES', the method 300 may proceed to determining a number of slug precursors $N_W$, as at 310. In an embodiment, this may be conducted as described above.

The method 300 may then determine whether the number (density) of slugs N is less than the number (density) of slug precursors $N_W$, as at 312. If the number of slugs N is greater than the number of slug precursors $N_W$ (e.g., the determination at 312 is 'NO'), the method 300 may determine that the second condition is not met, and thus no slugs will be initiated at this time step, at this pipe length, and may thus move to the next pipe length or time step. On the other hand, if the number of slugs N is not greater than the number of slug precursors (e.g., the determination at 312 is 'YES'), the method 300 may continue to determining a slug birth rate, as at 314. The slug birth rate B model may be determined as described above, for example.

The method 300 may then probabilistically initiate a slug based at least partially on the birth rate B, e.g., at least partially on the difference between the slug front velocity and the slug tail velocity, as at 316. For example, the greater the birth rate and/or the greater the difference between the front and tail velocities, the higher the likelihood of a slug initiation. However, slug initiation, even in high-probability situations, may not be a certainty. Thus, in some cases, such probabilistic initiation may not actually result in a slug being initiated, but in others, it may.

Whether a slug flow is initiated or not, the method 300 may, in some embodiments, determine whether to proceed to another round of analysis, e.g., at another pipe length and/or another time step, as at 318. If no further analysis is required, the method 300 may terminate (and control may be passed, e.g., to other methods). If analysis at another pipe length or time step is desired, the method 300 may loop back to 304. If a time step is advanced, the fluid flow model may thus be updated, such that new values for the slug front velocity and slug tail velocity, among other things, may be calculated for a given length of pipe.

Figure 4:
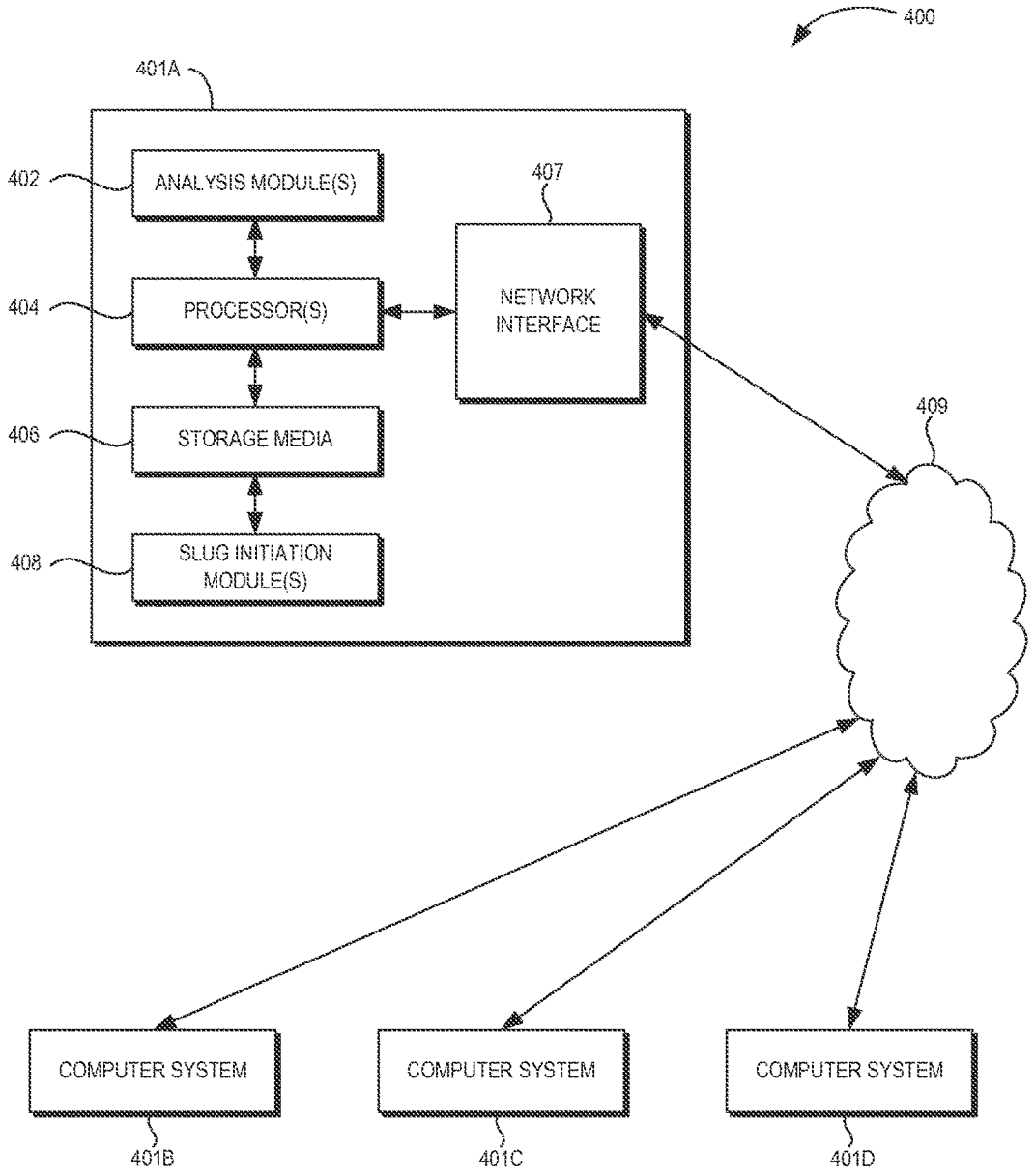
FIG. 4 illustrates a schematic view of a computing system, according to an embodiment.

In some embodiments, the methods of the present disclosure may be executed by a computing system. FIG. 4 illustrates an example of such a computing system 400, in accordance with some embodiments. The computing system 400 may include a computer or computer system 401A, which may be an individual computer system 401A or an arrangement of distributed computer systems. The computer system 401A includes one or more analysis modules 402 that are configured to perform various tasks according to some embodiments, such as one or more methods disclosed herein. To perform these various tasks, the analysis module 402 executes independently, or in coordination with, one or more processors 404, which is (or are) connected to one or more storage media 406. The processor(s) 404 is (or are) also connected to a network interface 407 to allow the computer system 401A to communicate over a data network 409 with one or more additional computer systems and/or computing systems, such as 401B, 401C, and/or 401D (note that computer systems 401B, 401C and/or 401D may or may not share the same architecture as computer system 401A, and may be located in different physical locations, e.g., computer systems 401A and 401B may be located in a processing facility, while in communication with one or more computer systems such as 401C and/or 401D that are located in one or more data centers, and/or located in varying countries on different continents).

A processor may include a microprocessor, microcontroller, processor module or subsystem, programmable integrated circuit, programmable gate array, or another control or computing device.

The storage media 406 may be implemented as one or more computer-readable or machine-readable storage media. Note that while in the example embodiment of FIG. 4 storage media 406 is depicted as within computer system 401A, in some embodiments, storage media 406 may be distributed within and/or across multiple internal and/or external enclosures of computing system 401A and/or additional computing systems. Storage media 406 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 400 contains one or more slug initiation module(s) 408. In the example of computing system 400, computer system 401A includes the slug initiation module 408. In some embodiments, a single slug initiation module may be used to perform some or all aspects of one or more embodiments of the methods disclosed herein. In alternate embodiments, a plurality of slug initiation modules may be used to perform some or all aspects of methods herein.

It should be appreciated that computing system 400 is only one example of a computing system, and that computing system 400 may have more or fewer components than shown, may combine additional components not depicted in the example embodiment of FIG. 4, and/or computing system 400 may have a different configuration or arrangement of the components depicted in FIG. 4. The various components shown in FIG. 4 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

It is important to recognize that fluid flow interpretations, models, and/or other interpretation aids may be refined in an iterative fashion; this concept is applicable to the methods discussed herein. This may include use of feedback loops executed on an algorithmic basis, such as at a computing device (e.g., computing system 400, FIG. 4), and/or through manual control by a user who may make determinations regarding whether a given step, action, template, model, or set of curves has become sufficiently accurate for the evaluation of the flow under consideration.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A method for modeling slug flow, comprising:

receiving a fluid flow model comprising a representation of one or more conduits and a multiphase fluid flow therein;

determining, using a processor, a slug birth rate in the multiphase fluid flow, wherein the slug birth rate is determined based at least partially on a difference between a slug front velocity and a slug tail velocity;

initiating a slug in the fluid flow model based at least partially on the slug birth rate; and displaying data representative of the slug flow in the model.

2. The method of claim 1, wherein initiating the slug in the model comprises determining that a minimum slip condition is satisfied by the multiphase fluid flow.

3. The method of claim 2, further comprising calculating the minimum slip condition based at least partially on a difference between the slug front velocity and the slug tail velocity, wherein the minimum slip condition is satisfied when the slug front velocity is greater than the slug tail velocity.

4. The method of claim 1, wherein initiating the slug comprises:

determining a probability of slug formation by determining a number of slugs for one or more lengths of conduit for one or more time steps based at least in part on the slug birth rate;

generating a threshold number;

determining that the probability of slug formation exceeds the threshold number; and in response, initiating the slug in the model at the one or more lengths of conduit.

5. The method of claim 4, wherein the threshold number is a random or pseudo-random number selected in a predetermined range of numbers.

6. The method of claim 4, wherein determining the slug birth rate comprises:

determining a first difference between the slug front velocity and a the slug tail velocity;

determining a second difference between a maximum number density of slug precursors and a local number density of slugs for the one or more lengths of conduit; and determining the slug birth rate based on the first difference, the second difference, and a diameter of the one or more lengths of conduit.

7. The method of claim 6, wherein initiating a slug comprises probabilistically initiating a slug based on a probability of slug initiation, wherein the probability of slug initiation increases when the first difference or the second difference increases.

8. The method of claim 1, wherein determining the slug birth rate comprises determining the slug birth rate based at least in part on a degree of instability of local separated flow and a spatial density of slug precursors.

9. A computing system, comprising:

one or more processors; and a memory system comprising one or more non-transitory computer-readable media storing instructions that, when executed by at least one of the one or more processors, cause the computing system to perform operations, the operations comprising:

receiving a fluid flow model comprising a representation of one or more conduits and a multiphase fluid flow therein;

determining a slug birth rate in the multiphase fluid flow, wherein the slug birth rate is determined based at least partially on a difference between a slug front velocity and a slug tail velocity;

initiating a slug in the fluid flow model based at least partially on the slug birth rate; and displaying data representative of the slug flow in the model.

10. The system of claim 9, wherein initiating the slug in the model comprises determining that a minimum slip condition is satisfied by the multiphase fluid flow.

11. The system of claim 10, wherein the operations further comprise calculating the minimum slip condition based at least partially on a difference between the slug front velocity and the slug tail velocity, wherein the minimum slip condition is satisfied when the slug front velocity is greater than the slug tail velocity.

12. The system of claim 9, wherein initiating the slug comprises:

determining a probability of slug formation by determining a number of slugs for one or more lengths of conduit for one or more time steps based at least in part on the slug birth rate;

generating a threshold number;

determining that the probability of slug formation exceeds the threshold number; and in response, initiating the slug in the model at the one or more lengths of conduit.

13. The system of claim 12, wherein the threshold number is a random or pseudo-random number selected in a predetermined range of numbers.

14. The system of claim 12, wherein determining the slug birth rate comprises:

determining a first difference between the slug front velocity and the slug tail velocity;

determining a second difference between a maximum number density of slug precursors and a local number density of slugs for the one or more lengths of conduit; and determining the slug birth rate based on the first difference, the second difference, and a diameter of the one or more lengths of conduit.

15. The system of claim 14, wherein initiating a slug comprises probabilistically initiating a slug based on a probability of slug initiation, wherein the probability of slug initiation increases when the first difference or the second difference increases.

16. The system of claim 9, wherein determining the slug birth rate comprises determining the slug birth rate based at least in part on a degree of instability of local separated flow and a spatial density of slug precursors.

17. A non-transitory computer-readable medium storing instructions that, when executed by at least one processor of a computing system, cause the computing system to perform operations, the operations comprising:

receiving a fluid flow model comprising a representation of one or more conduits and a multiphase fluid flow therein;

determining a slug birth rate in the multiphase fluid flow, wherein the slug birth rate is determined based at least partially on a difference between a slug front velocity and a slug tail velocity;

initiating a slug in the fluid flow model based at least partially on the slug birth rate; and displaying data representative of the slug flow in the model.

18. The medium of claim 17, wherein initiating the slug comprises:

determining a probability of slug formation by determining a number of slugs for one or more lengths of conduit for one or more time steps based at least in part on the slug birth rate;

generating a threshold number;

determining that the probability of slug formation exceeds the threshold number; and in response, initiating the slug in the model at the one or more lengths of conduit.

19. The medium of claim 17, wherein determining the slug birth rate comprises:

determining a first difference between a velocity of a slug front and a velocity of a slug tail;

determining a second difference between a maximum number density of slug precursors and a local number density of slugs for one or more lengths of conduit; and determining the slug birth rate based on the first difference, the second difference, and a diameter of the one or more lengths of conduit.

20. The method of claim 1, further comprising causing a real-world pump or valve to actuate in response to initiating the slug in the fluid flow model.

* * * * *